United States Patent [19]

Tomb

[11] Patent Number: 4,945,594

[45] Date of Patent: Aug. 7, 1990

[54] COVERED BRIDGE STRUCTURE

[76] Inventor: Richard H. Tomb, 130 Davis St., Painted Post, N.Y. 14870

[21] Appl. No.: 328,529

[22] Filed: Mar. 24, 1989

[51] Int. Cl.[5] ..... E01D 1/00

[52] U.S. Cl. ..... 14/1; 14/74

[58] Field of Search ..... 14/1, 3, 4, 6, 2.4, 14/13, 17, 19, 20, 74; 52/309.11, 731

[56] References Cited

U.S. PATENT DOCUMENTS 3,995,080 11/1976 Cogburn et al. ..... 52/731 X 4,795,666 1/1989 Okada et al. ..... 52/309.11 X

OTHER PUBLICATIONS

The Bridges of Pittsburgh, White et al, 1928, Cramer Printing & Publishing Company.

A Record of History and Evolution of Early American Bridges, Edwards, 1959, University Press Bridges, Weale, 1839, London.

*Primary Examiner*—William P. Neuder

*Attorney, Agent, or Firm*—Howard J. Greenwald

[57] ABSTRACT

A covered structure comprising a covered bridge and at least one covered entrance to said bridge is described. The covered bridge contains a bridge frame, a deck, a bridge enclosure framework disposed above the deck, means for connecting the bridge frame to the deck and the bridge enclosure framework, and a glass enclosure attached to the bridge enclosure framework. The bridge enclosure framework contains a multiplicity of vertical columns and a multiplicity of roof trusses.

The vertical columns and roof trusses contain at least about 45 weight percent of inorganic fiber and, in addition, a resin and/or plastic material.

20 Claims, 5 Drawing Sheets

COVERED BRIDGE STRUCTURE

FIELD OF THE INVENTION

A covered structure comprised of a covered bridge and a covered bridge entrance.

BACKGROUND OF THE INVENTION

Reinforced concrete and steel bridges are commonly used in the United States; they are strong and relatively lightweight. However, the materials used in these bridges degrade relatively rapidly when subjected to the elements. Steel bridge structures are subject to rusting and corrosion. Reinforced concrete bridge structures are subjected to crumbling and corrosion.

The need to use salt to keep bridge decks clear of ice and/or snow, in addition to causing deterioration of the bridge, also pollutes the runoff from the bridge with the salt and, with many bodies of water, adversely affects the chemical composition of the water and the life cycle of organisms in the water.

Another substantial problem with prior art bridges is that their structural parts, which are often made out of galvanized steel, are attacked and degraded by the chemical pollutants present in automotive emissions and/or in acid rain. Such emissions frequently contains nitrogen oxides and sulfur dioxides, each of which, when they combine with water, form strong acids and cause corrosion.

Covered bridges, such as wooden covered bridges, are well known. However, the prior art covered bridges either did not have the strength and durability of modern day bridges, or were to heavy, or did not adequately resistant to the effects of weathering and chemical attack.

It is an object of this invention to provide a covered bridge structure which is relatively strong, which is relatively lightweight, and which will be substantially more durable than the prior art bridge structures. It is a further object of this invention to provide a covered bridge structure whose structural members are not readily attacked by the pollutants in automotive emissions or in acid rain.

SUMMARY OF THE INVENTION

In accordance with this invention, there is disclosed a covered structure comprising a covered bridge and at least one covered entrance to said bridge. The covered bridge contains a bridge frame, a deck, a bridge enclosure framework enveloping the deck, means for connecting the bridge frame to the deck and the bridge enclosure framework, and a glass enclosure attached to the bridge enclosure framework. The bridge enclosure framework contains a multiplicity of vertical columns and a multiplicity of roof trusses.

The vertical columns and roof trusses contain at least about 45 weight percent of inorganic fiber and, in addition, a resin and/or plastic material.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

In one preferred embodiment of this invention, the covered structure of this invention is an integral structure comprised of a covered bridge and a covered entrance to the bridge which is connected to the bridge. As used in this specification, the term bridge refers to a structure which spans a body of water, a valley, or a road and affords passage for pedestrians, vehicles of any or all kinds, and combinations thereof. The covered bridge portion of the structure is comprised of a bridge frame, a deck, a bridge enclosure framework which is disposed above the deck and which comprises a a multiplicity of columns and trusses, both of which are preferably comprised of inorganic fiber, means for connecting the deck to the bridge frame, means for connecting the bridge enclosure framework to the bridge frame, and and a glass enclosure attached to said framework.

Figure 1:
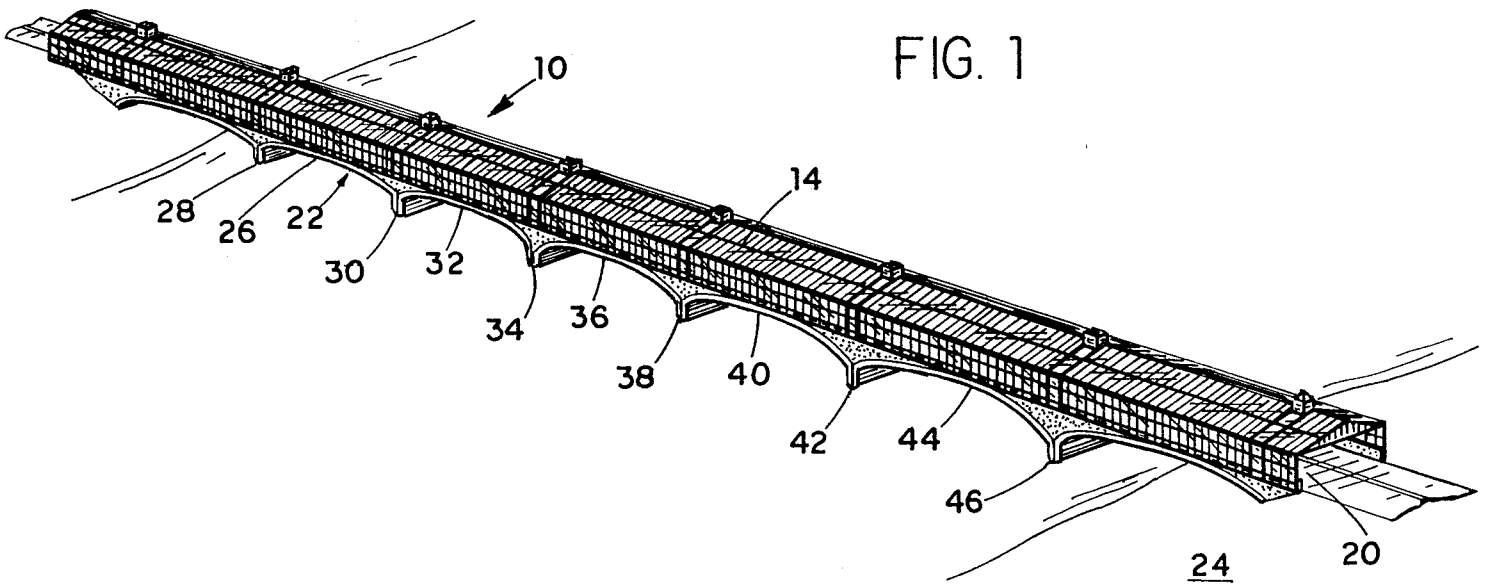
FIG. 1 is an aerial, three-quarters view of a preferred embodiment of a glass-covered bridge structure constructed in accordance with the present invention.

Referring to FIG. 1, one of the preferred embodiments of the covered structure 10 of this invention comprised of a covered bridge is illustrated. As used in this specification, the term covered bridge refers to a bridge whose deck is sheltered from the elements by means of a roof and at least two sidewalls. FIG. 1 illustrates one of the preferred covered cantilever bridges of this invention. As will be readily apparent to those skilled in the art, the invention also includes other types of bridges. Thus, by way of illustration and not limitation, one may utilize beam bridges, composite I-bream bridges, plategirder bridges, box girder bridges, truss bridges, continuous bridges, cantilever bridges, suspension bridges, movable bridges, drawbridges, bacule bridges, vertical-lift bridges, swing bridges, pontoon bridges, and the like. These bridges, and others like them, are well known to those skilled in the art and are described in, e.g., Volume 2, "McGraw-Hill Encyclopedia of Science & Technology" (McGraw-Hill Book Company, New York, 1977), "Bridge Members and Details" (International Correspondence Schools, Scranton, Penna, 1929), and J. A. L. Waddell's "Bridge Engineering", First Edition, Volumes 1 and 2 (John Wiley & Sons, Inc., New York, 1916). The disclosure of each of these references is hereby incorporated by reference into this specification. The listing of bridges appearing at pages 1917–1918 of the Waddell reference is particularly useful.

The covered bridge of this invention is comprised of a bridge frame. As used in this specification, the term frame refers to the sustaining parts of a structure. As is known to those skilled in the art, the frame of a bridge usually comprises structural steel beams or concrete beams or concrete box beams. However, wood can be substituted for one or more of the above for shorter spans.

Figure 3:
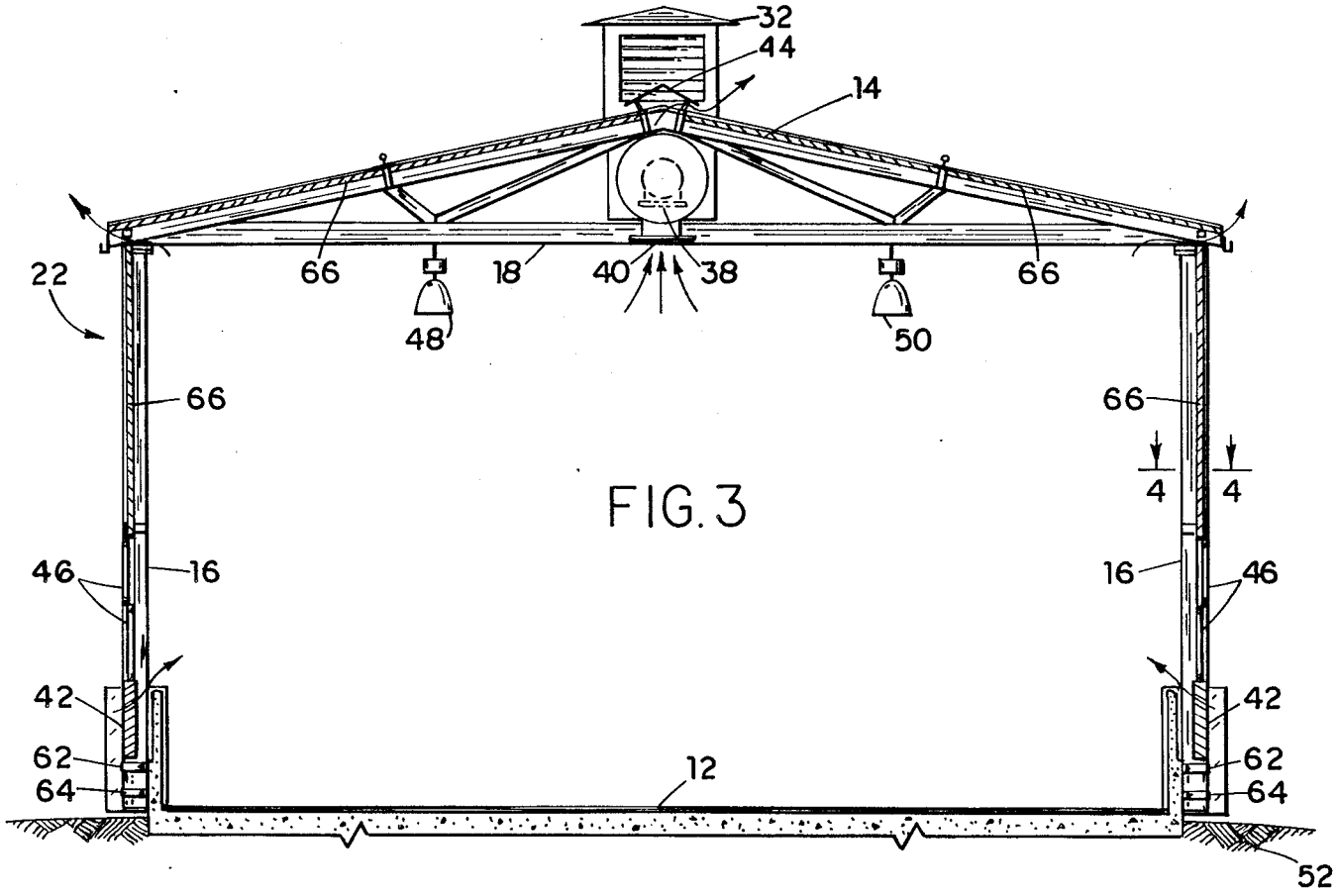
FIG. 3 is a cross-sectional view taken along line 3—3 of FIG. 2.

The covered bridge of this invention is comprised of a deck. As used in this specification, the term deck refers to a platform extending horizontally from one support to another; it is the flooring of a bridge. Thus, e.g., many types of materials may be used for decking. Thus, e.g., deck 12 is shown in FIG. 3.

Wood and reinforced concrete are commonly used. Asphaltic concrete covering (also known as asphalt) is the preferred paving material. However, as is known to those skilled in the art, the deck may be covered with other paving materials such as, e.g., tarred felt, fiberglass compositions, and the like.

Bridge decks are well known to those skilled in the art. Thus, e.g., such bridge decks are shown in U.S. Pat. No. 1,780,622 of Lawrence, U.S. Pat. No. 3,587,964 of Cork, U.S. Pat. No. 4,151,025 of Jacobs, and U.S. Pat. No. 4,362,586 of Uffner et al. The disclosure of each of these patents is hereby incorporated by reference into this specification.

The deck of the covered bridge of this invention is preferably comprised of at least about 80 weight percent of an inorganic material selected from the group consisting of concrete, reinforced concrete, structural steel, and mixtures thereof. As used in this specification, the term concrete refers to an engineering material consisting of a hydraulic cementing substance, aggregate, water, and often controlled amounts of entrained air. Concrete is described, e.g., in Volume 3 of said "Encyclopedia of Science & Technology" at pages 309–408 thereof.

In one preferred embodiment, the deck consists essentially of reinforced concrete. In this embodiment, the concrete may be reinforced with metal reinforcing rods, wire mesh, and the like. In one of the more preferred embodiments, the reinforced concrete deck is covered with asphalt.

Figure 2:
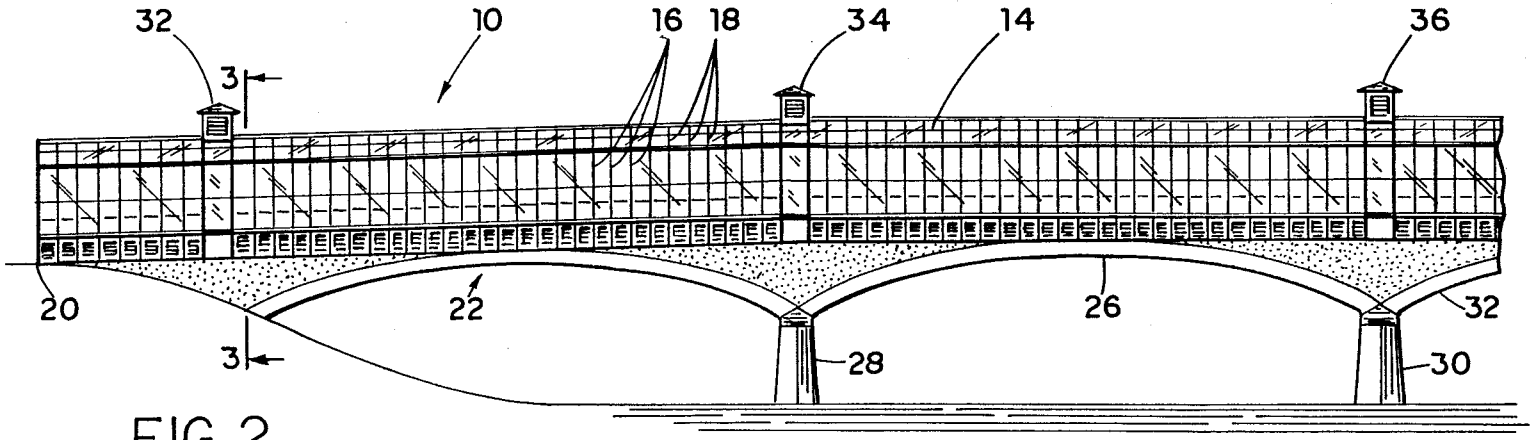
FIG. 2 is an enlarged side view of one end of the bridge of FIG. 1.

The covered bridge of this invention is comprised of a bridge enclosure framework attached to said deck. One preferred embodiment of this framework is illustrated in FIGS. 1 through 3. Referring to these FIGS. 2 and 3, framework 14 is comprised of a multiplicity of vertical columns 16 and a multiplicity of roof trusses 18 which preferably are attached to the upper end of vertical columns 16 with bolts, adhesive(s), screws, clamps, and other suitable fastening means.

In one preferred embodiment, both vertical columns 16 and roof trusses 18 are comprised of at least about 90 percent by weight of material selected from the group consisting of inorganic fiber, natural resin, synthetic resin, plastic, and mixtures thereof, provided that at least about 45 weight percent of such material is inorganic fiber. These materials are well known to those in the art and are described in, e.g., G. S. Brady's "Materials Handbook," Twelfth Edition (McGraw-Hill Book Company, New York, 1986), the disclosure of which is hereby incorporated by reference into this specification.

It is preferred that at least 95 weight percent of the material in columns 16 and trusses 18 consist of material selected from the group consisting of inorganic fiber, plastic, thermoset, and mixtures thereof.

In the preferred embodiment where the material is a composite of fiber and plastic, it is preferred that the composite contain from about 45 to about 75 weight percent (by total weight of fiber and plastic) of fiber and from about 55 to about 25 weight percent of plastic. It is preferred that the composite contain from about 50 to 70 weight percent of fiber and from about 30 to about 50 percent of plastic.

In one preferred embodiment, the fiber/plastic composite is a fiber reinforced plastic. As is known to those skilled in the art, fiber reinforced plastics are a group of composite materials composed of fibers embedded in a plastic resin matrix. See, e.g., pages 317–318 of G. S. Brady's "Materials Handbook," Twelfth Edition, supra,. The fiber in the composite may be glass, asbestos, paper, sisal, cotton, nylon, Kelvar, carbon, boron, graphite, and the like. The plastic resin used as the matrix for the fiber reinforced plastic may be polyester resin, vinylester, epoxy resin, and the like. Fillers may be used in the composite. Thus, e.g., the composite may be comprised of fillers such as aluminum silicate (preferably in the form of kaolin clay), calcium carbonate, alumina trihydrate, antimony trioxide, and the like.

One preferred class of fiber reinforced composites is sold by the the Creative Pultrusions, Inc. of Alum Bank, Pennsylvania. The 1989 "DESIGN GUIDE" available from such company, the disclosure of which is hereby incorporated by reference into this specification, describes "PULTEX" products made by the pultrusion process. These products preferably are fiberglass reinforced plastic materials manufactured from a variety of high performance thermostetting resins. The fibers in such resins generally have a density of from about 0.053 to about 0.094 pounds per cubic inch, a tensile strength of from about 75,000 to about 665,000 pounds per square inch, a tensile modulus of from about 10.5 million to about 55 million pounds per square inch, and an elongation to break of from about 0.5 to about 5.4 percent. The resins used in such composites generally have a tensile strength of from about 11,000 to about 11,800 pounds per square inch, an elongation of from about 4.2 to about 6.3 percent, a flexural strength of from about 16,700 to about 19,400 pounds per square inch, a flexuralmodulus of from about 0.45 to about 0.47 million pounds per square inch, a heat distortion temperature of from about 170 to about 330 degrees Fahrenheit, a Barcol hardness of from about 30 to about 50, and a specific gravity of form about 1.12 to about 1.28. Standard tests may be used to evaluate these properties. Thus, e.g., one may use A.S.T.M tests D790 (flexural properties), D695 (compressive strength), D638 (tensile strength), D732 (shear strength), D258381 (Barcol Hardness), D1505-68 (density), D792(specific gravity), G-53 (weathering), D635 (flammability), and the like.

The covered bridge of this invention also is comprised of means for connecting the deck to the bridge frame. Such connection may be made by means well known to those skilled in the art. Thus, by way of illustration and not limitation, one may make such connection with shear stud connectors.

The covered bridge of this invention also is comprised of means for connecting the bridge enclosure framework to the bridge frame. Such connection may be made by means well known to those skilled in the art. Thus, by way of illustration and not limitation, one may make such connection by means of masonry anchors, chem anchors (an anchor which extrudes an epoxy glue after being inserted into the anchorage hole), anchor plates embedded into the concrete, weldments to the structural steel, and the like.

The figures illustrate one preferred embodiment of the covered structure of this invention. Thus, referring to FIG. 1, covered structure 10 is is comprised of covered bridge entrance 20 and covered bridge 22. Although both bridge entrance 20 and bridge 22 are both covered by framework 14, they differ in that only bridge 22 spans either a body of water, a valley, or a road. Bridge entrance 20 spans nothing; it rests upon ground 24.

Covered structure 10 is comprised of section 26 extending between pier 28 and pier 30, section 32 extending between pier 30 and pier 34, section 36 extending between pier 34 and pier 38, section 40 extending between pier 38 and pier 42, and section 44 extending between 42 and 46. In the embodiment illustrated in FIG. 1, each of sections 26, 32, 36, 40 and 44 are similar to each other. In another embodiment, not shown, one or more of such sections differs from one or more of the other sections. Depending upon the length and configuration of the covered bridge one desires, one may use different numbers, lengths, widths, and shapes of said sections.

FIG. 2 is a partial sectional view of the bridge of FIG. 1. Referring to FIG. 2, the covered bridge 22 portion of covered structure 10 is comprised of a multiplicity of vertical columns 16, a multiplicity of roof trusses 18, spans 26 and 32, piers 28 and 30, and cupolas 32, 34, and 36. The framework 14 of the covered bridge 22 is comprised of said columns 16 and trusses 18; the trusses 18 are preferably attached to the upper ends of the vertical columns 16 by approprimate fastening means such as, e.g., bolts, adhesive, etc.

FIG. 3 is a cross-sectional view taken along line 3—3 of FIG. 2 illustrating one preferred means for ventilating covered structure 10. In the embodiment illustrated in this Figure, forced ventillation may be obtained by means of a motor driven fan 38 which pulls air from inside the bridge covering structure through inlet 40 and expels it to the outside atmosphere through the louvered cupolas 32. Natural ventilation is obtained by outside air entering a multiplicity of louvers 42 and exiting at an inverted "V" outlet 44 at the peak of the roof. Further natural ventilation may be obtained by opening the double hung windows 46 located on either lower side of the bridge covering structure. Lights 48 and 50 provide overhead illumination.

Figure 5:
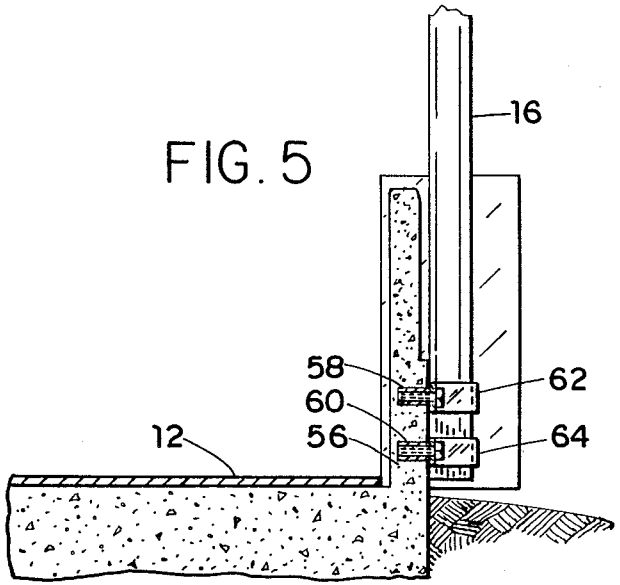
FIGS. 4 and 5 illustrate two means of attaching vertical columns to either a concrete footing (FIG. 4) or a bridge framework (FIG. 5).
Figure 4:
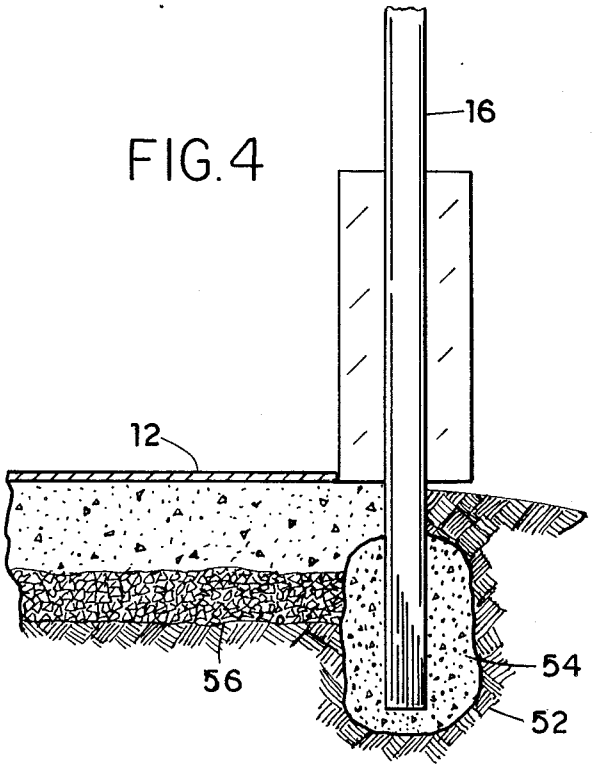

Vertical columns 16 may be installed in either a roadway or the bridge by means well known to those skilled in the art. Thus, referring to FIG. 4, when vertical columns 16 are to be used for the framework to cover the bridge entrance 20, a footer may be dug in earth 52, and column 16 may be set into the hole and secured there by cement 54 and/or gravel 56. Thus, referring to FIG. 5, when vertical columns 16 are to be used for the framework to cover the bridge 22, columns 16 may be secured to concrete bridge section 56 by means of lead inserts and/or chem inserts 58 and 60 and/or clamps 62 and 64.

Panes of glass 66 are attached to the framework 14 by means well known to those skilled in the art in order to cover both bridge entrance 20 and bridge 22. As is known to those skilled in the art, glass is an amorphous solid made by fusing silica with a basic oxide; see, e.g., pages 231–234 of Volume 6 of the McGraw-Hill Encyclopedia of Science & Technology (McGraw-Hill Book Company, New York, 1977), the disclosure of which is hereby incorporated by reference into this specification.

In one preferred embodiment, glass panes 66 consist essentially of laminated glass. Laminated glass, which is often also referred to as laminated safety glass or safety glass, is a structure containing two or more pieces of glass held together by an intervening layer or layers or plastic material(s); see, e.g., E. C. Van Schoick's "Ceramic Glossary" (American Ceramic Society, Columbus, Ohio, 1963), the disclosure of which is hereby incorporated by reference into this specification. Although the laminated glass may crack and break under sufficient impact, the pieces of glass tend to adhere to the plastic and not to fly.

In one embodiment, the laminated glass is produced by sandwiching a layer of clear or tinted polyvinyl butyral between two pieces of annealed float glass. The sandwich is gently heated under vacuum, which evacuates all air from the laminate, and is then heated to bonding temperature under pressure in an autoclave.

There are many commons types of laminated glass which may be utilized such as, e.g., reflective, heat-absorbing, or tinted glass, or combinations with clear glass. The glass may be heatstrengthened or tempered to produce greater strength. Plastic material, such as polycarbonate, may be laminated between glass to produce strong, vandal-proof glass. In one embodiment, laminated photochromic glass, which changes its color in response to variations in light intensity, is used.

Figure 6A:
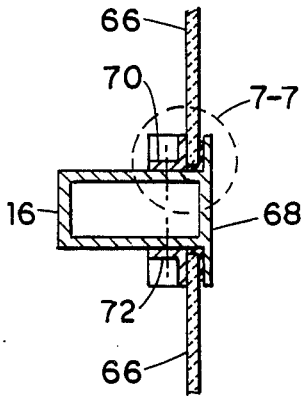
FIGS. 6A, 6B, and 7 illustrate several different means of securing glass panes to the vertical columns used in applicant's bridge structure.
Figure 6B:
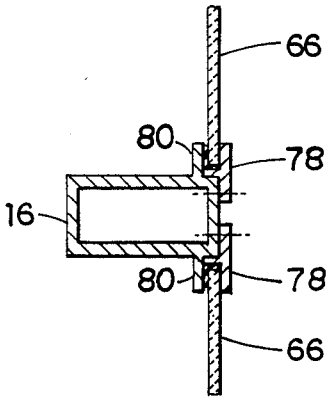
Figure 7:
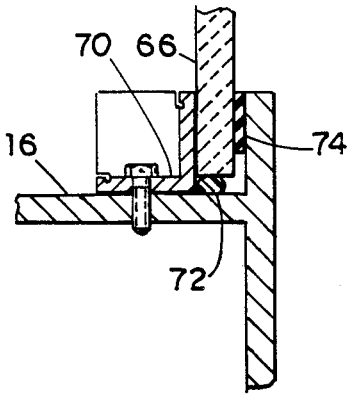

The glass panes 66 may be attached to the framework 14 by means well known to those skilled in the art. Thus, referring to FIG. 6A, panes of glass 66 may be sandwiched between wall 68 of vertical column 16 and L-shaped retaining bars 70 and 72. Such a sandwich construction is illustrated in FIG. 7, in which embodiment bead of caulk 72 and butyl tape 74 help to cushion glass 66 in the sandwich structure, and fastener 76 is used to secure L-shaped retaining bar 70 to vertical column 16. An alternative construction is illustrated in FIG. 6B, in which panes of glass 66 are sandwiched between walls 78 and 80 of column 16.

A glass enclosure comprised of a glass enclosure framework and pane glass may also be constructed of the entrance(s) to the bridge. Substantially the same structure used in covering the bridge may be used to cover the entrance; alternatively, one may use other enclosures.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims. Thus, instead of using a combination of columns and trusses in the covered bridge structure, one may substitute for one or more such columns and trusses curved beams which are comprised of at least 45 weight percent of said inorganic fiber and plastic. These curved beams are especially suitable for bridge structures with very large widths. In one preferred embodiment, the curved beams are covered by curved glass sections which add structural integrity to the covered structure because of the curvature of the glass; as is known to those in the art, glass is extremely strong under compression.

I claim:

1. A covered bridge structure comprising a covered bridge and at least one covered entrance to said bridge which is connected to said bridge, and means for ventilating said covered bridge, wherein:

(a) said covered bridge comprises a bridge frame, a deck, a bridge enclosure framework enveloping said deck, means for connecting said deck to said bridge frame, means for connecting said bridge enclosure framework to said bridge frame, and a glass enclosure attached to said bridge enclosure framework, wherein said deck is comprised of at least about 80 weight percent of an inorganic composition selected from the group consisting of concrete, reinforced concrete, and mixtures thereof;

(b) said bridge enclosure framework is comprised of a multiplicity of vertical columns and a multiplicity of roof trusses, wherein each of said roof trusses is connected to at least one of said vertical columns, and wherein both said vertical columns and said roof trusses are comprised of at least about 90 percent by weight of material selected from the group consisting of inorganic fiber, natural resin, synthetic resin, plastic, and mixtures thereof, provided that at least about 45 weight percent of such material is inorganic fiber;

(c) said means for ventilating said covered bridge is comprised of a multiplicity of louvers and an inverted V-outlet; and (d) said glass enclosure is comprised of a multiplicity of panes of laminated reflective glass which are connected to said bridge framework enclosure, thereby sheltering said deck from the elements.

2. The covered structure as recited in claim 1, wherein said inorganic fiber has a density of from about 0.053 to about 0.094 pounds per cubic inch.

3. The covered structure as recited in claim 2, wherein said inorganic fiber has a tensile strength of from about 275,000 to about 665,000 pounds per square inch.

4. The covered structure as recited in claim 3, wherein said inorganic fiber has a tensile modulus of from about 10.5 million to about 55 million pounds per square inch.

5. The covered structure as recited in claim 4, wherein said inorganic fiber has an elongation to break of from about 0.5 to about 4.8 percent.

6. The covered structure as recited in claim 5, wherein said inorganic fiber is glass fiber.

7. The covered structure as recited in claim 6, wherein said material is selected from the group consisting of glass fiber and synthetic resin.

8. The covered structure as recited in claim 7, wherein said resin has a tensile strength of from about 11,000 to about 11,800 pounds per square inch.

9. The covered structure as recited in claim 8, wherein said resin has an elongation of from about 4.2 to about 6.3 percent.

10. The covered structure as recited in claim 9, wherein said resin has a flexural strength of from about 16,700 to about 19,400 pounds per square inch.

11. The covered structure structure as recited in claim 10, wherein said resin has a flexural modulus of from about 0.45 to about 0.47 million pounds per square inch.

12. The covered structure as recited in claim 11, wherein said resin has a heat distortion temperature of from about 170 to about 330 degrees Fahrenheit.

13. The covered structure as recited in claim 12, wherein said resin has a Barcol hardness of from about 30 to about 50.

14. The covered structure as recited in claim 13, wherein said resin has a specific gravity of from about 1.12 to about 1.28.

15. The covered structure as recited in claim 14, wherein said material comprises from about 50 to about 70 weight percent, by weight of inorganic fiber.

16. The covered structure as recited in claim 15, wherein said resin is polyester resin.

17. The covered structure as recited in claim 15, wherein said resin is vinylester resin.

18. The covered structure as recited in claim 15, wherein said resin is epoxy resin.

19. The covered structure as recited in claim 16, wherein said material is comprised of an inorganic filler.

20. The covered structure as recited in claim 19, wherein said filler is selected from the group consisting of aluminum silicate, calcium carbonate, alumina trihydrate, antimony trioxide, and mixtures thereof.

* * * * *